US006748981B2

(12) United States Patent
Gielen et al.

(10) Patent No.: US 6,748,981 B2
(45) Date of Patent: Jun. 15, 2004

(54) AIR SUPPLY CONTROLLER FOR WEFT INSERTION NOZZLES IN AN AIR JET LOOM

(75) Inventors: Markus Gielen, Lindau (DE); Adnan Wahhoud, Lindau (DE); Dieter Teufel, Langenargen (DE); Peter Schiller, Lindau (DE); Matthias Armbrust, Wangen (DE)

(73) Assignee: Lindauer Dornier Gesellschaft mbH, Lindau (DE)

( * ) Notice: Subject to any disclaimer, the term of this patent is extended or adjusted under 35 U.S.C. 154(b) by 63 days.

(21) Appl. No.: 10/150,566

(22) Filed: May 16, 2002

(65) Prior Publication Data

US 2002/0170615 A1 Nov. 21, 2002

(30) Foreign Application Priority Data

May 17, 2001 (DE) ..... 101 24 290

(51) Int. Cl.[7] ..... D03D 47/32
(52) U.S. Cl. ..... 139/435.2
(58) Field of Search ..... 139/435.1, 435.2, 139/435.3, 435.4, 435.5, 435.6; 226/97.1, 97.4

(56) References Cited

U.S. PATENT DOCUMENTS 4,187,888 A * 2/1980 van Mullekom ..... 139/435.1
4,410,016 A * 10/1983 Manders ..... 139/435.2
4,446,893 A * 5/1984 Gunneman et al. ..... 139/11
4,634,387 A * 1/1987 Kuhn ..... 434/291
4,651,785 A * 3/1987 Volland et al. ..... 139/435.2
4,673,004 A * 6/1987 Rosseel et al. ..... 139/435.2
4,877,064 A * 10/1989 Pezzoli ..... 139/435.1
5,067,527 A * 11/1991 de Jager ..... 139/435.2
5,086,812 A * 2/1992 Van Bogaert et al. ... 139/435.2
6,062,273 A 5/2000 Peeters et al.

FOREIGN PATENT DOCUMENTS

EP 0279222 8/1988
JP 59-76949 5/1984

* cited by examiner

*Primary Examiner*—Danny Worrell
(74) *Attorney, Agent, or Firm*—W. F. Fasse; W. G. Fasse

(57) ABSTRACT

An arrangement for supplying air with a controlled pressure to the main weft insertion nozzles of an air jet loom includes a single servovalve connected between a pressurized air source, an air vent, and a pressure manifold, and individual shut-off valves respectively interposed in branch lines connected from the pressure manifold to the individual nozzles. A pressure sensor measures the actual pressure provided to the manifold. An electronic controller receives a pressure control signal and controls the servovalve responsive to any difference between the pressure control signal and the actual measured pressure signal. The arrangement is simple, economical, and rapidly reacting, to avoid the need of individual throttle valves or pressure regulators for the individual nozzles.

20 Claims, 1 Drawing Sheet

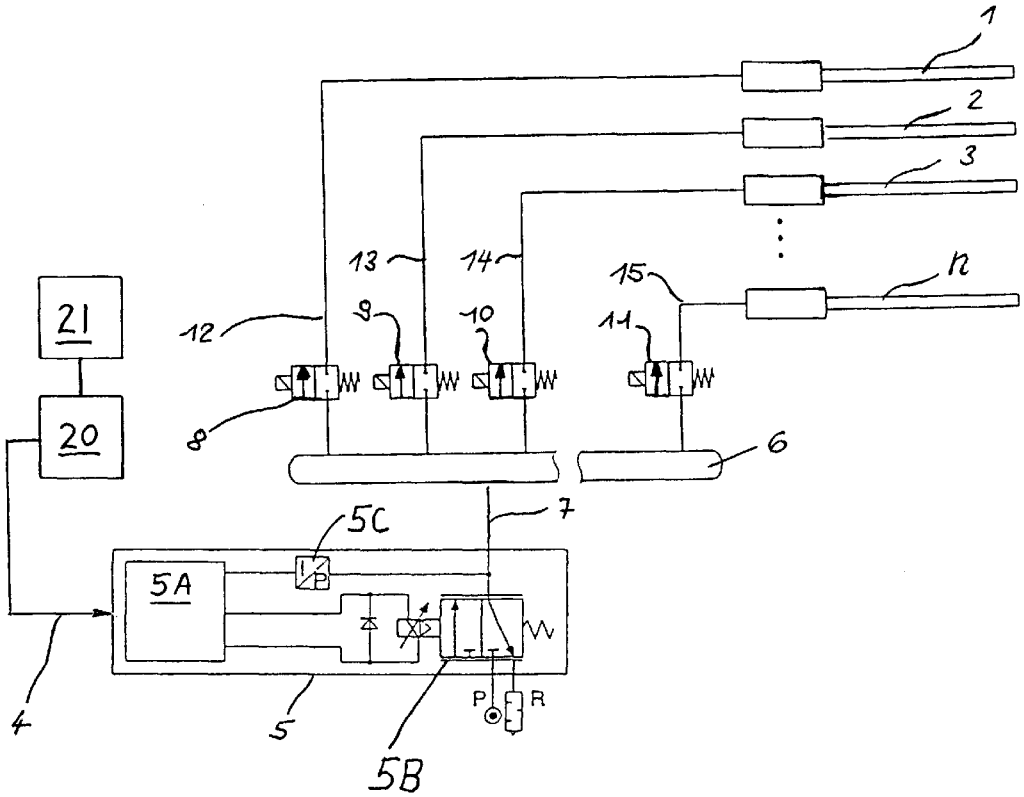
1
2
3
n
13
14
15
21
12
9
10
11
20
8
6
7
5C
5A
4
5
5B
P
R

AIR SUPPLY CONTROLLER FOR WEFT INSERTION NOZZLES IN AN AIR JET LOOM

PRIORITY CLAIM

This application is based on and claims the priority under 35 U.S.C. §119 of German Patent Application 101 24 290.5, filed on May 17, 2001, the entire disclosure of which is incorporated herein by reference.

FIELD OF THE INVENTION

The invention relates to a jet weaving loom, and especially an air jet loom with pneumatic weft insertion system and an air supply control and regulating system, or pressure controller, for controlling the supply of pressurized air to the main weft insertion nozzles and/or the auxiliary relay nozzles.

BACKGROUND INFORMATION

In jet weaving looms, and especially air jet looms, it is necessary to achieve a good impulse transfer or kinetic energy transfer from the transport medium such as air to the weft thread. In this regard, the characteristics of the particular thread type of the weft thread being inserted must be taken into account. For example, in connection with a so-called weft mixing in the weft thread insertion process, i.e. a transition from one weft thread type to a different weft thread type, it is known to vary the pressure of the transport medium being supplied to one or more weft thread insertion nozzles, in order to achieve a substantially constant weft thread flight time or transit time of the different thread types through the insertion channel of the weaving reed with a substantially constant rotational speed of the loom. This is important, because a weft thread that reaches the end of the weft thread insertion either too early or too late within a respective weaving cycle can lead to weaving faults.

One known proposal for achieving a constant weft thread flight or transit time for different weft thread types involves allowing so much time for each respective weft thread in a respective weaving cycle, and driving each weft thread with so much transport medium at such a pressure, so that it is practically ensured that both the slowest, as well as the fastest weft thread will be inserted through the insertion channel within the prescribed time window.

Another manner of carrying out the air supply control is that the pressure for all of the main weft insertion nozzles is controlled in common and set to a certain pressure level by a mechanical pressure regulator. Thus, the basic pressure level is first adjusted or set independent of the quality or characteristic differences of the individual weft threads. Additionally, a respective adjustable throttle valve is allocated to each main insertion nozzle, whereby this throttle valve is used to individually adjust and set the particular pressure level required for achieving the prescribed weft thread flight or transit time for this associated weft thread, i.e. respectively for each main insertion nozzle.

The two above-mentioned manners of carrying out the air supply regulation and control are both rather uneconomical with respect to the provision and the consumption of the transport medium, i.e. the compressed air. Moreover, the individual allocation of a respective throttle valve to each respective main nozzle, and further to each respective so-called tandem main nozzle if the loom needs to be equipped with such tandem main nozzles, is rather costly, complicated, and time consuming with respect to the structural and installation effort of the control and regulating system, and with respect to the individual adjusting of the respective blowing air pressures at the respective throttle valves.

German Patent 30 43 003 discloses an air jet loom that is equipped with a measuring arrangement for measuring the transport velocity of the inserted weft thread, and with a control system in which a signal representative of the thread transport velocity is converted into a control signal, which in turn is used to influence or control the components of the weft thread insertion system that determine the insertion velocity of the weft thread. A person of ordinary skill will recognize from this German Patent, that the weft thread insertion system includes the main weft insertion nozzles, and that a pressure control or regulating valve is respectively allocated to each main nozzle.

SUMMARY OF THE INVENTION

In view of the above, it is an object of the invention to provide a control and regulating system for the pressurized fluid supply for the main weft insertion nozzles, and for the tandem main weft insertion nozzles when applicable, that is simple in its structure, operation, and maintenance, economical in its original manufacturing and installation costs, economical in operation with respect to the consumption of pressurized fluid medium, and also rapidly reacting, so that it can achieve the required pressure already at the start of the loom for the first weft thread insertion, as well as achieving any desired varied pressure level from one weft insertion to the next. The invention further aims to avoid or overcome the disadvantages of the prior art, and to achieve additional advantages, as apparent from the present specification.

The above objects have been achieved according to the invention in a control arrangement for controlling the supply of air to plural main weft insertion nozzles of an air jet loom. Each main nozzle can include a single main nozzle or tandem main nozzles. The overall air supply arrangement includes a pressurized air source, and a control and regulating system (also called a pressure controller herein for simplicity and brevity) interposed and connected between the pressurized air source and the main weft insertion nozzles.

Especially according to the invention, the control and regulating system for all of the main weft insertion nozzles includes only one single multi-path servovalve with an integrated pressure sensor and pressure regulation and control electronics. Particularly, the multipath servovalve may be any conventionally known 3/2 way or multipath servovalve, e.g. having a solenoid or other electromagnetic actuator. The pressure regulation and control electronics receive a control signal from an external controller. The pressure regulation and control electronics compare a measured pressure signal corresponding to the actual pressure measured downstream from the multipath servovalve, with the control pressure indicated by the external control signal. Responsive to any difference or deviation between the actual pressure and the desired control pressure, the pressure regulation and control electronics actuate the multipath servovalve to connect either the pressurized air source, an air vent, or a closed connection, with a main pressure line on the side of the multipath servovalve toward the main weft insertion nozzle arrangements, so as to regulate the actual pressure provided in this main pressure line to correspond to the desired control pressure. The electronics may comprise any hardware and/or software for receiving and comparing the actual pressure signal and the control pressure signal, e.g. including an amplifier, a comparator, etc.

According to further preferred embodiment features of the invention, the external controller provides the external control signal in consideration of or based on the measured actual value of the actual weft transport flight or transit time or the corresponding rotational angle of the loom main drive shaft, which actual value is compared with a prescribed nominal or rated value, whereupon the determined time or rotational angle difference is converted into the external control signal. Thereby, the pressure to be provided to the main weft insertion nozzles is adjusted to speed-up the weft insertion if the actual measured weft insertion was too slow, or to slow-down the weft insertion if the actual measured weft insertion was too fast.

Further preferably according to the invention, a pressure distributor (i.e. plenum or manifold) is connected to the main pressure line that extends from the output of the multipath servovalve of the pressure control and regulating system. In turn, plural respective secondary pressure lines branch off from the pressure distributor or manifold and lead individually to the plural main weft insertion nozzles. A respective individual servo shut-off valve is interposed in each of the individual secondary pressure lines. Thus, the multipath servovalve of the pressure control and regulating system sets the pressure being supplied to the pressure manifold, and the individual servo shut-off valves respectively individually control which weft insertion nozzle or nozzles will receive the pressurized air at the respective instantaneously prevailing pressure in the pressure manifold at any given time.

The inventive use of a single multipath 3/2 way servovalve with an integrated pressure sensor and pressure regulation and control electronics now advantageously makes it possible to adjust and set the pressure level of the pressurized air that will be supplied respectively to each individual main weft insertion nozzle in a direct manner, i.e. without requiring individual mechanical adjustment for each respective main nozzle arrangement via the control software of the air jet loom. Also, the system is substantially simplified in comparison to the prior art, because it is no longer necessary to provide the conventionally known allocation of a respective pressure control valve or throttle valve for each individual main nozzle or each tandem main nozzle, but instead to provide a single valve, which is able to switch from one pressure level to another pressure level in only a few milliseconds, for example within about 15 to 20 ms for switching from a first required pressure level of e.g. 2.5 bar to a second required pressure level of e.g. 5.0 bar. Thereby, it is possible to adjust the pressure level individually and successively for each weft insertion nozzle and for each successive weft insertion. The invention makes use of the fact that only one particular pressure level will be needed at any particular instant in time, regardless of how many total weft insertion nozzles are provided, for example for different selectable weft thread colors or thread qualities.

BRIEF DESCRIPTION OF THE DRAWING

In order that the invention may be clearly understood, it will now be described in connection with an example embodiment, with reference to the accompanying drawing, wherein the single FIGURE schematically shows the inventive air supply arrangement for a weft thread insertion system of an air jet loom.

DETAILED DESCRIPTION OF PREFERRED EXAMPLE EMBODIMENTS AND OF THE BEST MODE OF THE INVENTION

The illustrated weft thread insertion system includes a pneumatic pressure source or pressurized air source P, an air venting outlet connection R, a plurality of weft insertion nozzles 1, 2, 3, . . . n, which are especially main weft insertion nozzles (either individual main nozzles or tandem main nozzles), as well as the inventive air supply system connected between the pressurized air source P, the air venting outlet connection R, and the several weft insertion nozzles 1, 2, 3, . . . n. The air supply system supplies air from the pressurized air source P in a controlled and selective manner to the respective insertion nozzles 1, 2, 3, . . . n such that the nozzles transport the respective selected weft thread through the weft thread insertion channel of a weaving reed (not shown). Note that the further auxiliary relay nozzles of the weft insertion system are not shown.

Additional means 21 (e.g. weft thread detectors, a timer, a rotation angle sensor, etc., which can be embodied in any conventionally known manner) serve to measure the actual time, or the corresponding rotational angle of the main drive shaft of the loom, required for the weft thread to be transported through the weft insertion channel across the weaving width. This measured time or rotational angle value is provided as an actual value to an external controller 20, which in turn compares the actual value to a corresponding prescribed nominal or desired value, and then converts the determined difference or deviation of the time or rotational angle values to a representative control signal. This control signal is supplied via a signal line 4 to a control and regulating system (or pressure controller) 5 of the-inventive air supply arrangement.

The pressure control and regulating system 5 comprises a multipath servovalve 5B, which may have any conventionally known configuration and arrangement, and in the present example embodiment is a multipath 3/2 way servovalve. The servovalve 5B includes a valve body as well as a servo-actuator that may be an electrical solenoid or any other conventionally known actuator. The pressure control and regulating system 5 further includes pressure regulation and control electronics 5A and a pressure sensor 5C, which may each respectively be embodied in any conventionally known manner for carrying out the functions described herein.

The pressure sensor 5C senses or measures the pressure prevailing at a first port of the valve 5B, and provides a corresponding actual pressure signal to the pressure regulation and control electronics 5A, which further receive the external control signal via the control signal line 4. The pressure regulation and control electronics 5A compare the actual pressure signal from the pressure sensor 5C with the pressure control signal provided on the signal line 4, and then output a valve actuation signal to actuate the servovalve 5B based on any difference determined between the actual pressure signal and pressure control signal, for example, so as to drive the actual pressure signal to match the pressure control signal, i.e. so that the actual pressure prevailing at the first port of the servovalve corresponds to the nominal or desired pressure at any given time. This is achieved as follows.

A second port of the valve 5B is connected to the pressurized air source P, and a third port of the valve 5B is connected to the air venting outlet connection R. The valve 5B is actuated by the electronics 5A as necessary to establish the required pressure at the first port of the valve 5B by rapidly and selectively switching the valve 5B to provide a connection between the first port and either the second port (i.e. the pressurized air source P) or the third port (i.e. the air venting outlet connection R), or to provide no through-connection at all, at any given time.

Note that the schematic illustration of the valve 5B shows the two possible through-connected states, and it should be further understood that a third possible state, e.g. between the two illustrated states, provides no through-connection among the three ports. The pressure available from the pressurized air source P is at or above the highest pressure that may be required by the control signal provided on the signal line 4, while the pressure of the air venting outlet connection R is lower than the lowest pressure required (for example the air venting outlet connection vents to the ambient environment at ordinary atmospheric pressure).

As schematically indicated in the drawing FIGURE, the entire air supply arrangement, which provides pressurized air selectively and controlledly to all of the weft insertion nozzles 1, 2, 3, . . . n, which may be individual main nozzles, tandem main nozzles, (or optionally might even include auxiliary relay nozzles), or any combination thereof, includes only a single pressure control and regulating system 5 as described above. While a second port of the valve 5B is connected to the pressurized air source P, and a third port of the valve 5B is connected to the air venting outlet connection R, the first port of the valve 5B is connected by a main pressure line 7 to a pressure distributor, plenum or manifold 6. Thus, the controlled pressure provided by the valve 5B, i.e. by the pressure control and regulating system 5, is supplied to the pressure manifold 6.

In turn, respective secondary pressure lines 12, 13, 14, and 15 are branched off from the pressure manifold 6 and lead individually to the weft insertion nozzles 1, 2, 3, . . . n. A respective individual servo shut-off valve 8, 9, 10, 11 is respectively interposed in each respective one of the secondary pressure lines 12, 13, 14, 15. The valves 8, 9, 10, 11 are not adjustable throttle valves, nor any manner of pressure regulating valves. Instead, the valves 8, 9, 10, 11 are preferably simple solenoid controlled 2-position on-off valves that selectively either open or close the flow communication path through the respective secondary pressure lines 12, 13, 14, 15 from the pressure manifold 6 to the respective weft insertion nozzles 1, 2, 3, . . . n. Thereby, at any given time, the pressurized air is supplied from the pressure manifold 6 through any respective open one of the shut-off valves 8, 9, 10, 11 to the respective associated weft insertion nozzle 1, 2, 3, . . . n, at the pressure prevailing in the pressure manifold 6 at that time.

An example of the operation of the inventive air supply system will now be described. The air jet loom has the weft thread insertion system set up to operate with three different weft threads. Each weft thread has a different thread characteristic or quality, so that each weft thread will require a different individually adjusted main nozzle pressure for achieving the rated weft thread flight time or transit time that is to be the same for all of the weft threads. Accordingly, the operator of the loom inputs corresponding commands at an operator console of the loom communicating with the external controller 20, to prescribe a pressure value of 3 bar for the weft thread to be inserted by the first main nozzle 1, a pressure value of 5 bar for the weft thread to be inserted by the second main nozzle 2, and a pressure value of 2 bar for the weft thread to be inserted by the third main nozzle 3.

These prescribed pressure values are provided to the controller 20, which first sends a corresponding control signal via the signal line 4 to the control and regulating system 5, for adjusting the supply pressure to the desired nominal pressure value of 3 bar that will be used for inserting the first weft thread with the first main nozzle 1. As a result, the pressure regulation and control electronics 5A appropriately actuate the valve 5B to establish the required pressure of 3 bar in the pressure manifold 6. Then, at the appropriate time (based on a control signal received by an individual valve control line that is not illustrated), the shut-off valve 8 opens the flow path through the first secondary pressure line 12 leading to the first main nozzle 1, so that the pressurized air is supplied at the established pressure of 3 bar to the first main nozzle 1.

Then, at the appropriate time, the shut-off valve 8 is closed to discontinue the supply of air to the first main nozzle 1, and then the external controller 20 provides a new signal via the signal line 4 to the pressure control and regulating system 5 to set the supply pressure to the next desired nominal pressure value of 5 bar. Accordingly, the electronics 5A appropriately control the valve 5B to establish the pressure of 5 bar in the pressure manifold 6, whereupon then the shut-off valve 9 is opened, to open the flow path through the second secondary pressure line 13 to the second main nozzle 2, so as to provide pressurized air at a pressure of 5 bar to this second main nozzle 2.

At this point, the established pressure of 5 bar still prevails or is supplied to the pressure manifold 6. However, for the next weft insertion, a lower pressure value of 2 bar will be required as mentioned above. In such a case, when a subsequent weft insertion will require a lower pressure than a prior weft insertion, the pressure control and regulating system 5 receives the corresponding lower pressure control signal via the signal line 4 and appropriately controls a valve 5B, to connect the first port to the third port thereof, which connects the main pressure line 7 to the air venting outlet connection R, such that the higher pressure level prevailing in the pressure manifold 6 is vented and reduced at least to such an extent that the new required pressure level is established. Namely in the present example, the new pressure level of 2 bar will be established and then maintained in the pressure manifold 6 by appropriate control of the valve 5B. Then the shut-off valve 10 will be opened to open the flow path through the third secondary pressure line 14 to the third main nozzle 3 with the appropriate pressure of 2 bar.

The above described cycle is repeated with the pressure in the pressure manifold 6 being rapidly successively set to the appropriate required pressure levels for all of the weft insertion nozzles that are connected to this pressure manifold. To minimize the consumption and waste of pressurized air, especially when a lower pressure level follows a higher required pressure level, the internal volume of the pressure manifold 6 is preferably minimized.

Tests carried out by the inventors have shown that the inventive air supply system using a single multipath servovalve, such as a 3/2-way servovalve with an integrated pressure sensor and pressure regulation and control electronics as the pressure control and regulating system for providing pressurized air to the main nozzles and/or tandem main nozzles, can surprisingly achieve adequately short switching times and stable pressure values even for loom drive shaft rotational speeds over 1000 r.p.m. and pressure values ranging from 2.5 to 5 bar. This can be achieved especially because this single valve arrangement can achieve switching and pressure regulation times of about 15 to 20 msec for switching from a pressure of 2.5 bar to a pressure of 5.0 bar.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A weft insertion system for an air jet loom comprising:

a pressurized air source;

plural weft insertion nozzles; and an air supply system that is connected between said pressurized air source and said weft insertion nozzles to control and supply pressurized air from said pressurized air source to said weft insertion nozzles;

wherein said air supply system includes a single pressure controller that includes pressure regulation and control electronics, a pressure sensor, and a single servovalve interconnected between said pressurized air source and all of said plural weft insertion nozzles.

2. The weft insertion system according to claim 1, wherein said servovalve is a multipath servovalve actuated by an actuator that is connected to be controlled by said pressure regulation and control electronics.

3. The weft insertion system according to claim 2, wherein said multipath servovalve is a 3/2 way multipath valve.

4. The weft insertion system according to claim 1, wherein said plural weft insertion nozzles consist of individual main weft insertion nozzles, and all of said individual main weft insertion nozzles are connected to said air supply system so as to selectively receive pressurized air via said single servovalve.

5. The weft insertion system according to claim 4, wherein said weft insertion system further comprises plural auxiliary relay nozzles.

6. The weft insertion system according to claim 1, wherein said plural weft insertion nozzles comprise plural sets of tandem main weft insertion nozzles.

7. The weft insertion system according to claim 1, further comprising an external controller connected to said pressure regulation and control electronics and adapted to provide a control pressure signal to said pressure regulation and control electronics.

8. The weft insertion system according to claim 7, further comprising a weft sensor arrangement and one of a loom shaft angle sensor arrangement and a timer, which are connected to said external controller and adapted to provide to said external controller an actual value signal indicative of an actual time or an actual loom shaft rotation angle required for a respective weft insertion transit, wherein said external controller is adapted to compare said actual value signal to a nominal value to determine a difference value therebetween and to generate said control pressure signal dependent on said difference value.

9. The weft insertion system according to claim 8, wherein said external controller is further adapted to receive an external control input and to generate said control pressure signal dependent on said external control input.

10. The weft insertion system according to claim 1, wherein said air supply system further includes a pressure distribution manifold connected by a main pressure line to said single servovalve, and plural secondary pressure lines respectively connecting said pressure distribution manifold individually to said plural weft insertion nozzles.

11. The weft insertion system according to claim 10, wherein said air supply system further includes plural electromagnetically actuated control valves respectively individually interposed in said secondary pressure lines between said pressure distribution manifold and said plural weft insertion nozzles.

12. The weft insertion system according to claim 11, wherein said control valves are solenoid actuated on-off shut-off valves.

13. The weft insertion system according to claim 10, wherein said pressure controller is interposed between said pressurized air source and said pressure distribution manifold.

14. The weft insertion system according to claim 1, further comprising an air vent connected to said single servovalve.

15. The weft insertion system according to claim 1, expressly excluding individual throttle valves connected respectively individually to said weft insertion nozzles, and expressly excluding individual pressure regulating valves connected respectively individually to said weft insertion nozzles.

16. The weft insertion system according to claim 1, wherein said single pressure controller is the only pressure regulating device in said air supply system.

17. A weft insertion system for an air jet loom comprising:

plural weft insertion nozzles;

plural on-off shut-off valves respectively having inlet ports, and respectively having outlet ports that are respectively connected individually to said plural weft insertion valves; and a single pressure control valve having a first port that is connected to said inlet ports of all of said on-off shut-off valves, and having a second port that is adapted to be connected to a pressurized air source.

18. The weft insertion system according to claim 17, further comprising an air manifold interposed and interconnected between said first port of said pressure control valve and said inlet ports of all of said on-off shut-off valves.

19. The weft insertion system according to claim 17, further comprising said pressurized air source connected to said second port of said pressure control valve, and wherein said pressure control valve further has a third air venting port.

20. A weft insertion system for an air jet loom comprising:

plural weft insertion nozzles;

an air manifold connected to all of said plural weft insertion nozzles;

means for establishing a selected air pressure in said air manifold; and means for selectively conducting air at said selected air pressure from said air manifold to any selected one of said weft insertion nozzles.

* * * * *